US006770241B2

(12) United States Patent
Gregory

(10) Patent No.: US 6,770,241 B2
(45) Date of Patent: Aug. 3, 2004

(54) CRUCIBLE HANDLING DEVICE

(76) Inventor: Rawley T. Gregory, 15 State Route 60 S., New London, OH (US) 44851

( * ) Notice: Subject to any disclaimer, the term of this patent is extended or adjusted under 35 U.S.C. 154(b) by 112 days.

(21) Appl. No.: 10/175,652

(22) Filed: Jun. 20, 2002

(65) Prior Publication Data

US 2003/0234475 A1 Dec. 25, 2003

(51) Int. Cl.[7] ..... C21B 3/00
(52) U.S. Cl. ..... 266/276; 266/274; 414/586
(58) Field of Search ..... 266/274, 276; 414/586

(56) References Cited

U.S. PATENT DOCUMENTS 1,354,716 A * 10/1920 Beardsley ..... 414/586
1,560,241 A * 11/1925 Jones ..... 266/276
1,722,777 A * 7/1929 Wellman ..... 294/68.3

* cited by examiner

*Primary Examiner*—Scott Kastler
(74) *Attorney, Agent, or Firm*—Jerry Semer

(57) ABSTRACT

The invention is a device that is used to securely hold a crucible for lifting by a lifting device. It has a circular frame with a top bracing leg that ensures straight vertical lifting and proper alignment of the rigging. The frame diameter is slightly larger than the crucible. Vertical pieces extend downward from the top of the frame. At the bottom end of each of these vertical pieces, a hinged piece is attached. On the hinged pieces, a bottom rigging retainer is attached. The bottom rigging retainer allows the rigging to freely pass through it. The bottom rigging retainer with the hinged piece forms a loop through which the rigging is thread. The rigging securely holds the bottom of the crucible. A lifting device is attached to the riggings to lift the crucible. The frame can be made adjustable to fit many sizes of crucibles.

15 Claims, 6 Drawing Sheets

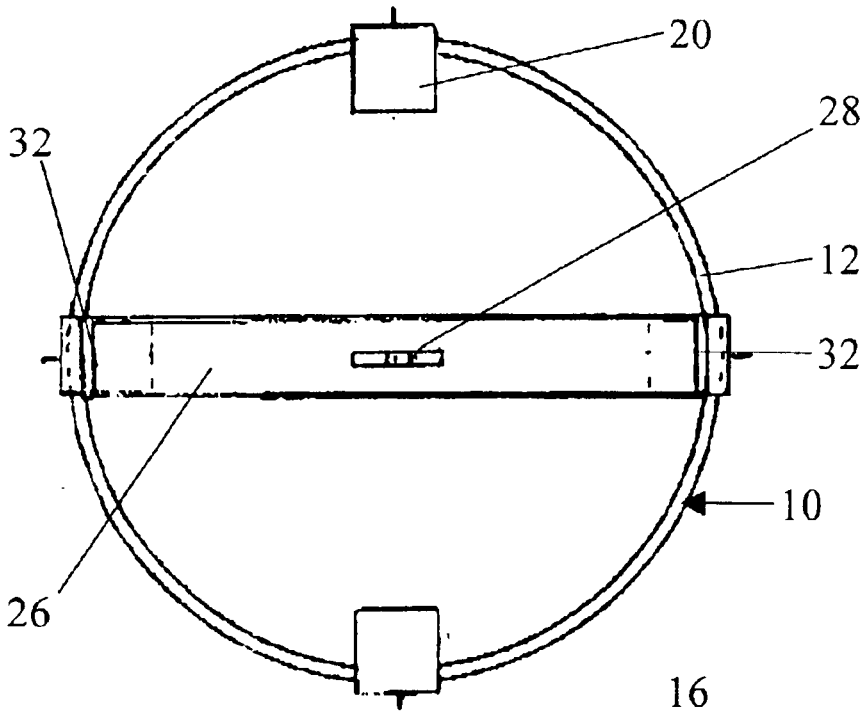
FIG 1
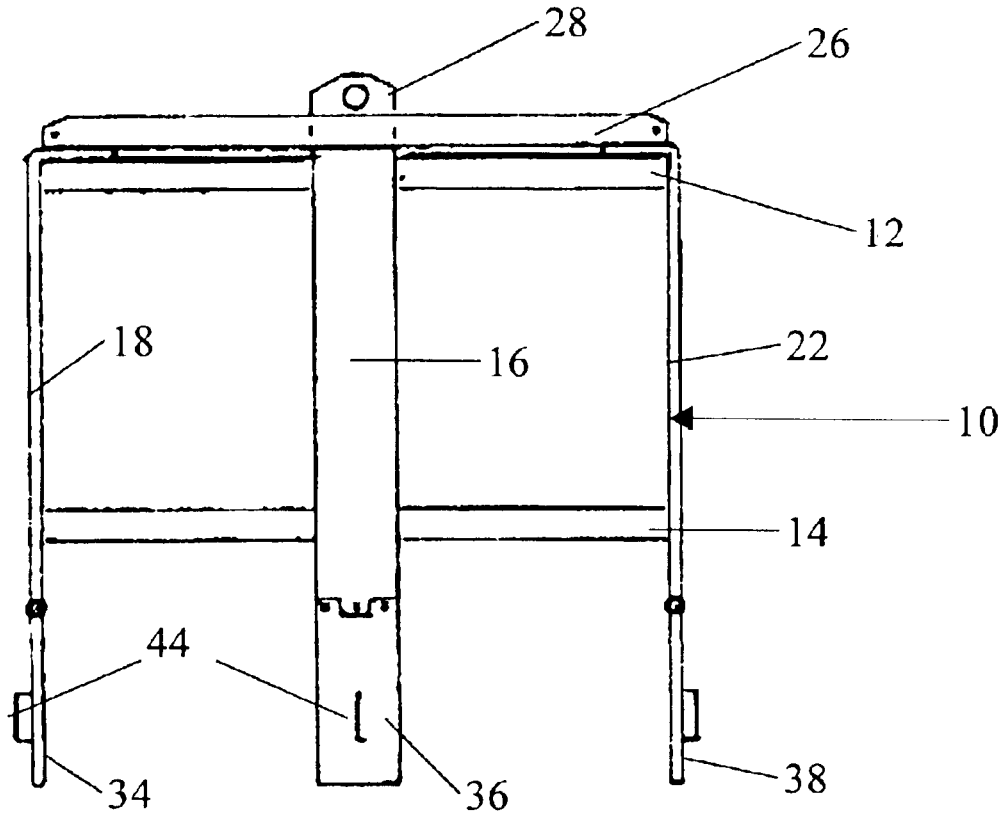

CRUCIBLE HANDLING DEVICE

FIELD OF THE INVENTION

This invention relates to the field of devices for handling crucibles and more particularly to the field of devices that handles crucibles while they are being lifted in and out of the melting furnace.

BACKGROUND OF INVENTION

Crucibles are expensive, they are made with very thin walls, and the walls become brittle after being in the furnace awhile. Thus, crucibles can be easily broken. In a foundry, one of the most dangerous times in dealing with crucibles is when the crucible is lifted out of the melting furnace. When the crucible is being lifted, it can be easily bumped into the melting furnace wall and break or crack or do damage to the furnace. Further, the heavy weight of the crucible makes it a safety hazard to the individuals lifting it. Thus, one of the objectives of this invention is to create a system that can lift a crucible from the melting furnace safely and without damage to the crucible or furnace. The device is also designed to place a new crucible back in the melting furnace without damaging the crucible and insuring a proper vertical placement.

In order for the lifter to ensure a safe handling of the crucible without damaging the crucible or allowing the crucible to strike against the furnace, the lifter must ensure a straight vertical lift of the crucible without having the crucible swing or make other potential damaging movements. The lifter must also be able to lift the crucible when there is a minimum clearance between the furnace walls and the crucible of two to three inches. These objectives must also be obtained with a device that is easy to use, inexpensive to build and maintain.

The features that allow the inventors lifter to achieve his objectives is that the lifter has a fabricated steel assembly that precisely positions, aligns, and engages and holds in place flexible rigging around the base of the crucible. Once this flexible rigging is aligned by the steel assembly, the crucible can be safely and securely lifted and manipulated.

SUMMARY OF THE INVENTION

The invention is a device that is used to securely hold a crucible for lifting by a lifting device. It has a circular frame with a top bracing leg that ensures straight vertical lifting and proper alignment of the rigging. The frame diameter is slightly larger than the crucible. Vertical pieces extend downward from the top of the frame. At the bottom end of each of these vertical pieces a hinged piece is attached. On the hinged pieces, a bottom rigging retainer is attached. The bottom rigging retainer allows the rigging to freely pass through it. The bottom rigging retainer with the hinged piece form a loop through which the rigging is thread. The rigging securely holds the bottom of the crucible. A lifting device is attached to the riggings to lift the crucible. The frame can be made adjustable to fit many sizes of crucibles.

BRIEF DESCRIPTION OF THE DRAWINGS

FIG. 1 is a top view of one embodiment of the invention.

FIG. 2 is a side view of one embodiment of the invention.

DETAILED DESCRIPTION OF THE PREFERRED EMBODIMENT

Figure 6:
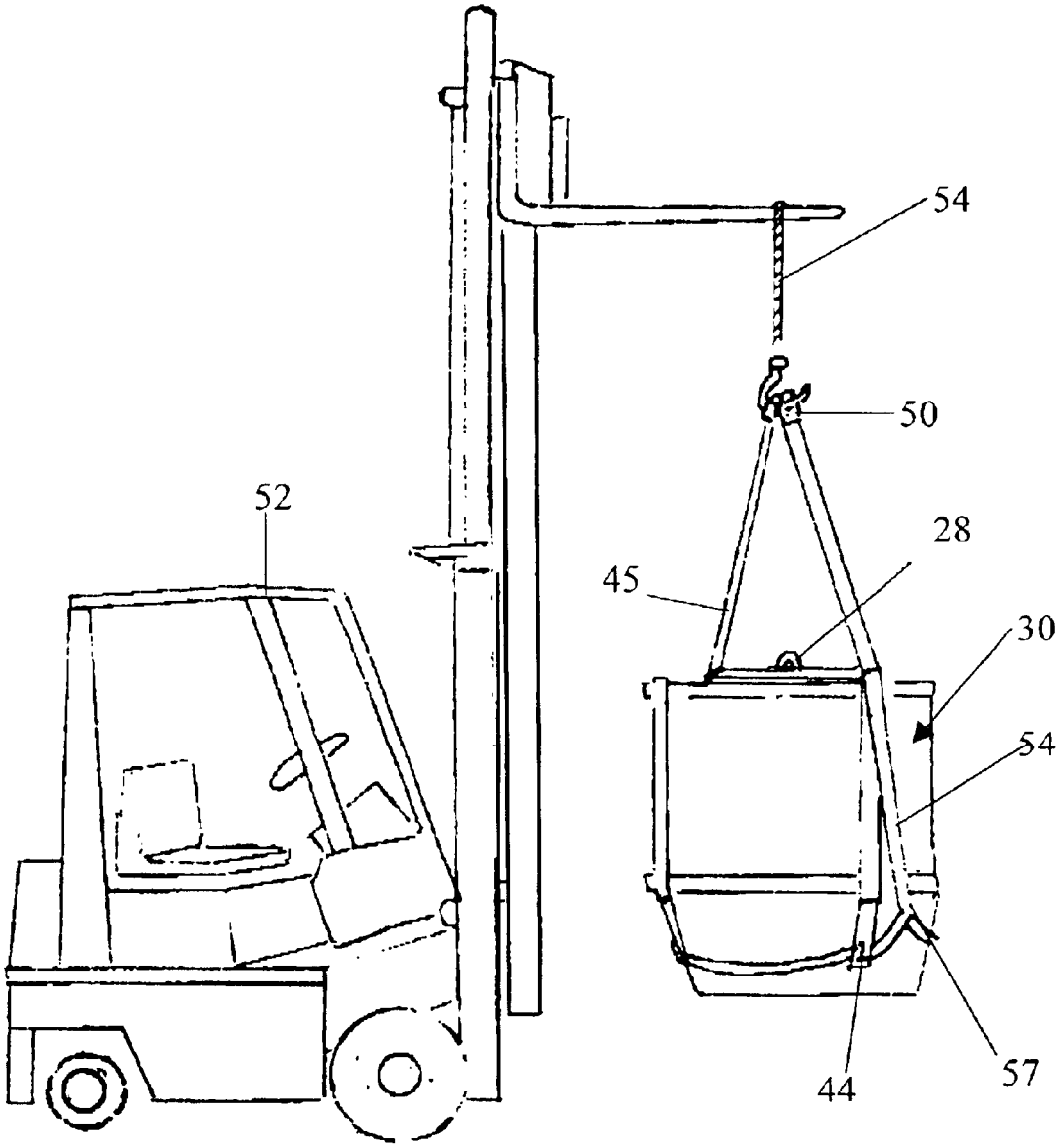
FIG. 6 is a view of the invention holding the crucible and attached to the lifting device.
Figure 7:
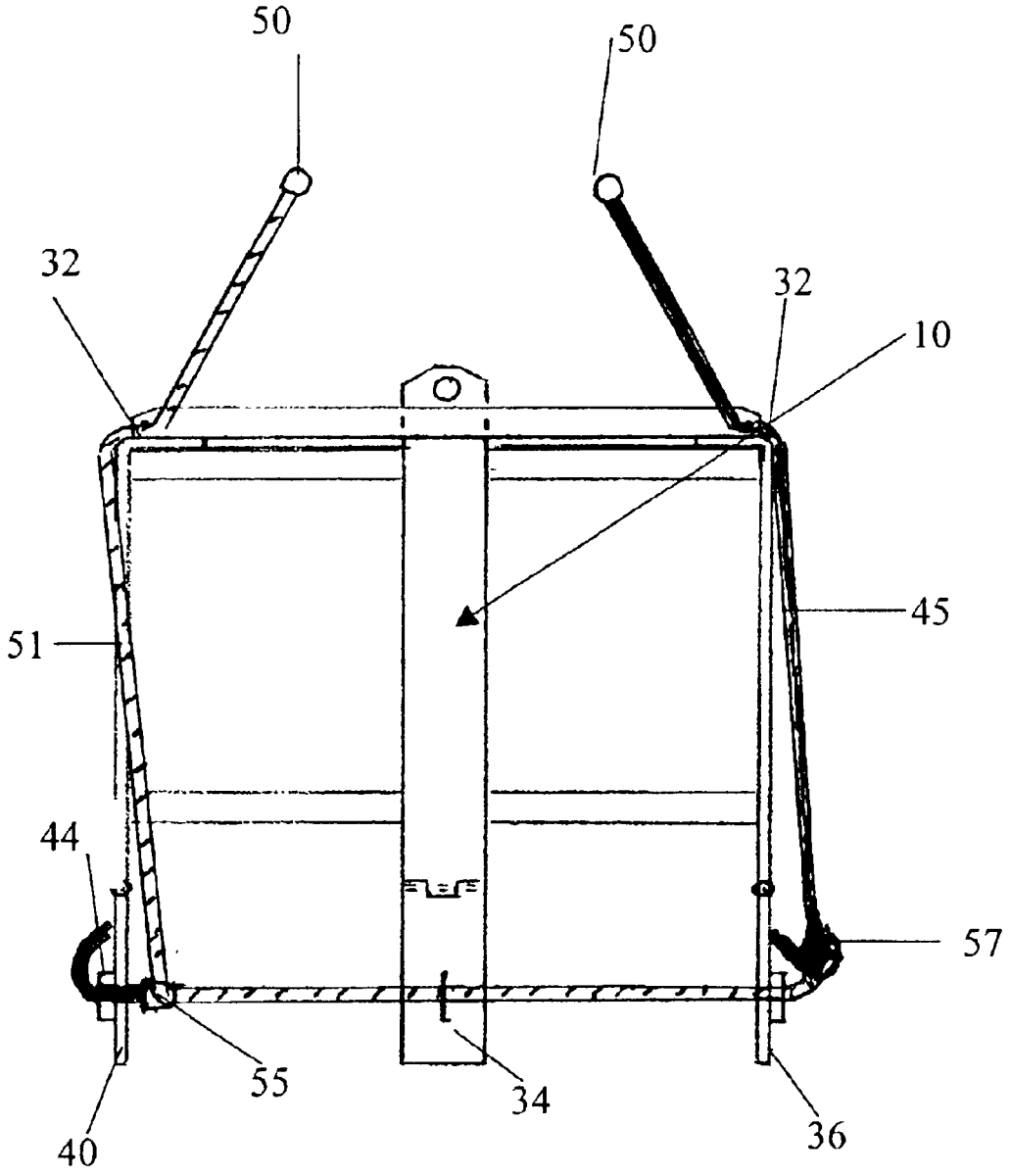
FIG. 7 is a side view of the invention with strap rigging

FIG. 1 is a prospective view of the fabricated metal assembly 10 of the invention. In the preferred embodiment, the fabricated metal assembly 10 is made of steel. However, other materials can be used that are known in the art. FIG. 2 shows that the fabricated metal assembly 10 is circular in design. The fabricated metal assembly 10 is circular in design because in the preferred embodiment the crucible 30 shown in FIG. 6 is circular. FIGS. 1 and 2 show that the fabricated metal assembly 10 has a top rings 12 and a bottom ring 14. Both the top and bottom rings 12 and 14 diameters are just slightly larger than the crucible's 30 diameter. These rings 12 and 14 in the preferred embodiment must be only slightly larger than the crucible's 30 diameter since the tolerance between the crucible 30 and the melting furnace is usually around three inches. The top and bottom rings 12 and 14 are held together by four side pieces 16, 18, 20 and 22. These four side pieces 16, 18, 20 and 22 are equally spaced around the top and bottom rings 12 and 14. The top and bottom rings 12 and 14 are attached to the side pieces 16, 18, 20, and 22 in the preferred embodiment by welding. However, they could be attached by other methods known in the art such as nuts and bolts. The top and bottom rings, 12 and 14, are formed with 2×¼ inch HRS steel bar stock. These are formed into the top and bottom rings 12 and 14 and welded together. In the preferred embodiment, the top and bottom rings 12 and 14 are only a quarter inch larger than the outer diameter of the crucible 30. As I pointed out above, the top and bottom rings 12 and 14 must be only slightly larger than the crucible 30 since on most furnaces there is less than three inches tolerance. The four vertical pieces 16, 18, 20, 22 that join the top and bottom rings, 12 and 14, are made out of 3½×¼ inch HRS steel bar stock.

All four of the vertical pieces 16, 18, 20, and 22 are bent at a 90 degree angle over the top ring 12 to provide additional support. The vertical pieces 16, 18, 20, and 22 extend below the bottom ring 14. In the preferred embodiment the vertical pieces 16, 18, 20, and 22 length is equivalent to the distance as measured from the top of the crucible 30 to the point where the crucible's 30 outside diameter begins to lessen. At the bottom end of each of the four vertical pieces 16, 18, 20, and 22, a male hinge bracket is welded in place. This male hinge bracket could also be attached by other methods known in the art such as nuts and bolts.

To the top ring 12, a section of 4×1½ inch U shaped channel 26 is attached. In the preferred embodiment, this U shaped channel 26 is attached by welding. However, there are other methods that are known in the art that could be used to attach the U shaped channel. This U shaped channel 26 is positioned over vertical pieces 18 and 22. A lifting lug 28 is welded in place directly in the center of the channel 26 to provide balance for vertical lifting of the assembly 10. At both ends of channel 26 an upper lifting strap retainers 32 are welded into position. The upper lifting strap retainer 32 could be attached by other methods known in the art.

Figures 3, 3A:
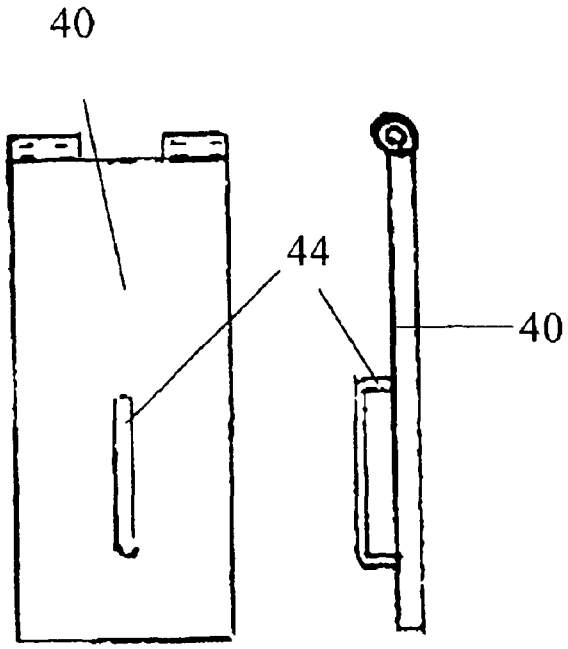
FIG. 3 is a front view of the hinged lifting strut.
FIG. 3A is a side view of hinged lifting strut.
Figure 3B:
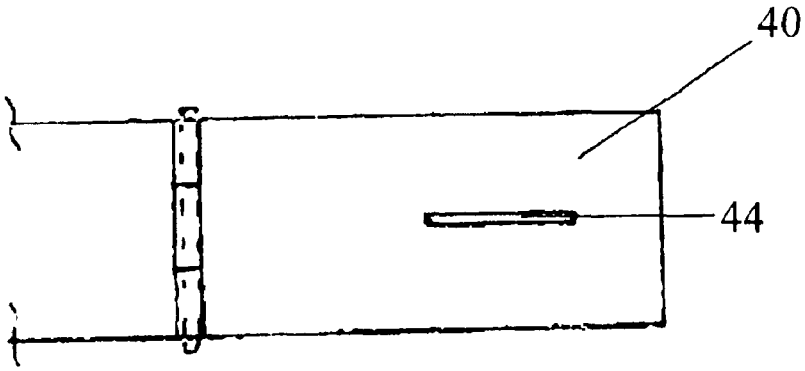
FIG. 3B is a front view of the hinged lifting strut attached to the vertical piece.
Figure 4:
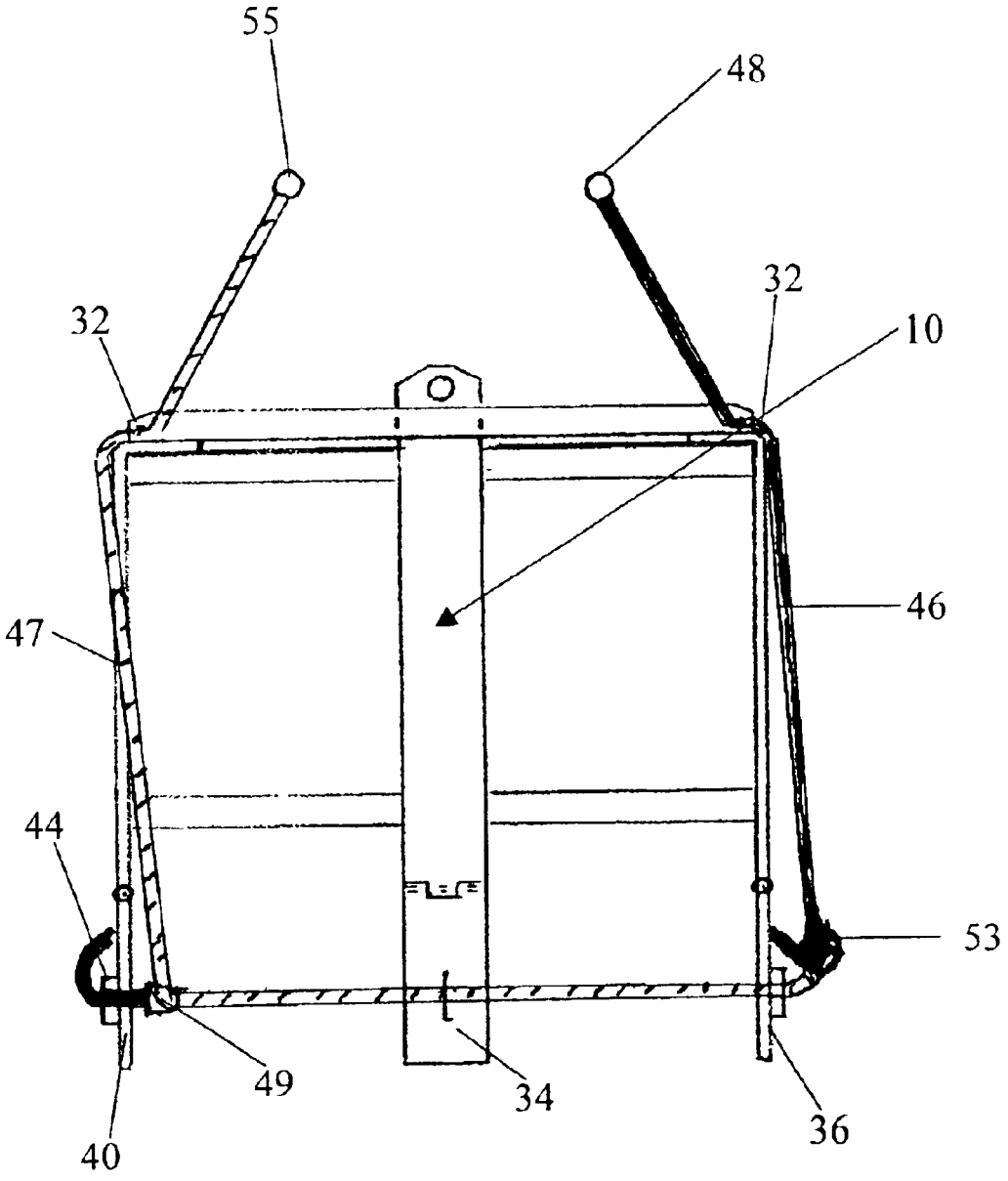
FIG. 4 is a side view of the invention with the cable rigging.

Four hinged lifting struts 34, 36, 38, and 40 shown in FIGS. 2 and 3 are attached to the vertical pieces 16, 18, 20, and 22. These hinged lifting struts 34, 36, 38, and 40 are produced from 3½×1 HRS steel bar stock. Each of these four hinged lifting struts 34, 36, 38 and 40 has a female hinge bracket welded in place to utilize the male hinge brackets. The length of each of the vertical pieces 16, 18, 20 and 22 and the length of the hinged lifting struts 34, 36, 38 and 40 cannot exceed or be equal to the overall height of the crucible 30. Near the end of the four hinged lifting struts 34, 36, 38 and 40 a lower rigging retainers 44 is welded in place as shown in FIGS. 2 and 4. The lower rigging retainers 44 create a loop. Through each of these loops formed by the lower rigging retainers 44, the rigging is threaded. The rigging in the preferred embodiment consists of two cables 46 and 47; however, it could consist of two pieces of industrial strapping. Each of the cables 46 and 47 has loops 48, 49, 53, and 55 at each end. If industrial strapping is used as shown in FIG. 6, each strap 45 and 51 has a loop 57 on one end and a buckle 50 at the other.

The rigging is thread as follows: First the cable 46 is run through the lower rigging retainer 44 of hinged lifting struts 40 and 38 and cable 47 is ran through the lower rigging retainer 44 of hinged lifting struts 34 and 36. Second, loop 48 on cable 46 is run through loop 53 on cable 47. Loop 48 of cable 46 is then run through the upper rigging retainer 32. Loop 55 on cable 47 is run through loop 49 on cable 46. Loop 55 of cable 47 is then run through the upper rigging retainer 32. Thus when the cables 46 and 47 are attached to the lifting device 52 through loops 48 and 55 and the lifting device moves upward the cables 46 and 47 place pressure on the hinged lifting struts 34, 36, 38, and 40 and they move inward griping the crucible 30 as shown in FIG. 6.

For the industrial strapping is used, first the strap 45 is run through the lower rigging retainer 44 of hinged lifting struts 38 and 40 and strap 51 is run through the lower rigging retainer 44 of hinged lifting struts 36 and 34. Second, buckle 50 on strap 45 is run through loop 57 on strap 51. Buckle 50 of strap 45 is then run through the upper rigging retainer 32. Buckle 50 on strap 51 is run through loop 55 on strap 45. Buckle 50 of strap 51 is then run through the upper rigging retainer 32. Thus when the straps 45 and 51 are attached to the lifting device 52 through buckle 50 and the lifting device moves upward the straps 45 and 51 place pressure on the hinged lifting struts 34, 36, 38, and 40 and they move inward griping the crucible 30.

To use the fabricated metal assembly 10 one positions the fabricated metal assembly 10 over the crucible 30. This can be done by using the lifting lugs 28 located on the U shaped channel of the fabricated metal assembly 10. The lifting lugs 28 are attached to the vertical lifting device 52 such as a forklift. This is usually done by a set of chains 54 being attached to the lifting lugs 28 and moving the vertical lifting device 52 upward. The vertical lifting device 52 then positions the fabricated metal assembly 10 over the crucible 30. Then the vertical lifting device 52 begins to lower the fabricated metal assembly 10 and the fabricated metal assembly 10 is positioned by individuals around the crucible 30. Then the rigging (cables 46 and 47 or straps 45 and 51) is attached to the vertical lifting device 52 through the buckles 50 or loop 48 and 55. As upward pressure is applied by vertical lifting device 52 to the rigging, the rigging place pressure on the hinged lifting struts 34, 36, 38, and 40 and the hinged lifting struts 34, 36, 38, and 40 move inward griping the crucible 30. A continued upward movement of the vertical lifting device 52 removes the crucible 30 from the furnace. Once clear of the furnace the vertical lifting device 52 with the crucible 30 as shown in FIG. 6 is moved to another location.

To disengage the vertical lifting device 52, the crucible 30 is placed on a firm, flat surface. The rigging is detached and the set of chains 54 are reattached to the lifting lug 28. The fabricated metal assembly 10 with rigging then is pulled up and removed.

To place a new crucible 30 in the furnace, the fabricated metal assembly 10 with rigging is lowered over the crucible 30. The vertical lifting device 52, through a set of chains 54 is then attached to the rigging by buckles 50 or loops 48 and 55. The vertical lifting device 52 then lifts, pulling the rigging and the hinged lifting struts 34, 36, 38, and 40 securely around the bottom of the crucible 30. The crucible 30 is then moved into place over the furnace and the vertical lifting device 52 lowers the crucible 30 down into the furnace. Once the crucible 30 is in place the vertical lifting device 52 continues to lower to take the pressure from the rigging. The rigging is then detached from the vertical lifting device 52. The vertical lifting device 52 then is reattached to the lifting lugs 28, and lifts the fabricated metal assembly up 10 and rigging out of the furnace and off the crucible 30. The crucible 30 is now in place and ready for use.

Figure 5:
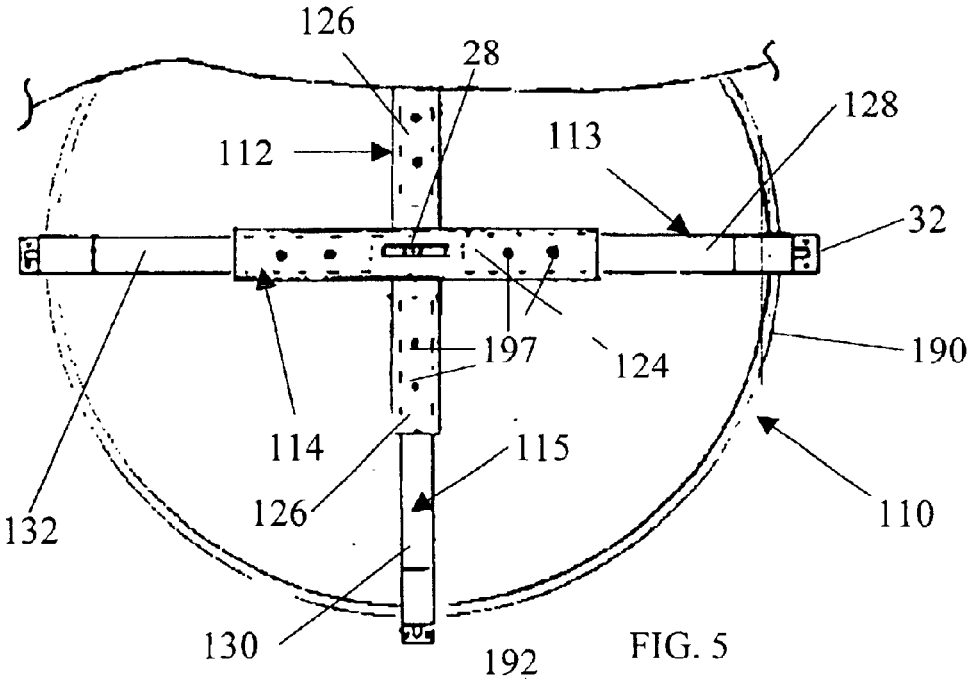
FIG. 5 is a top view of another embodiment of the invention.
Figure 5A:
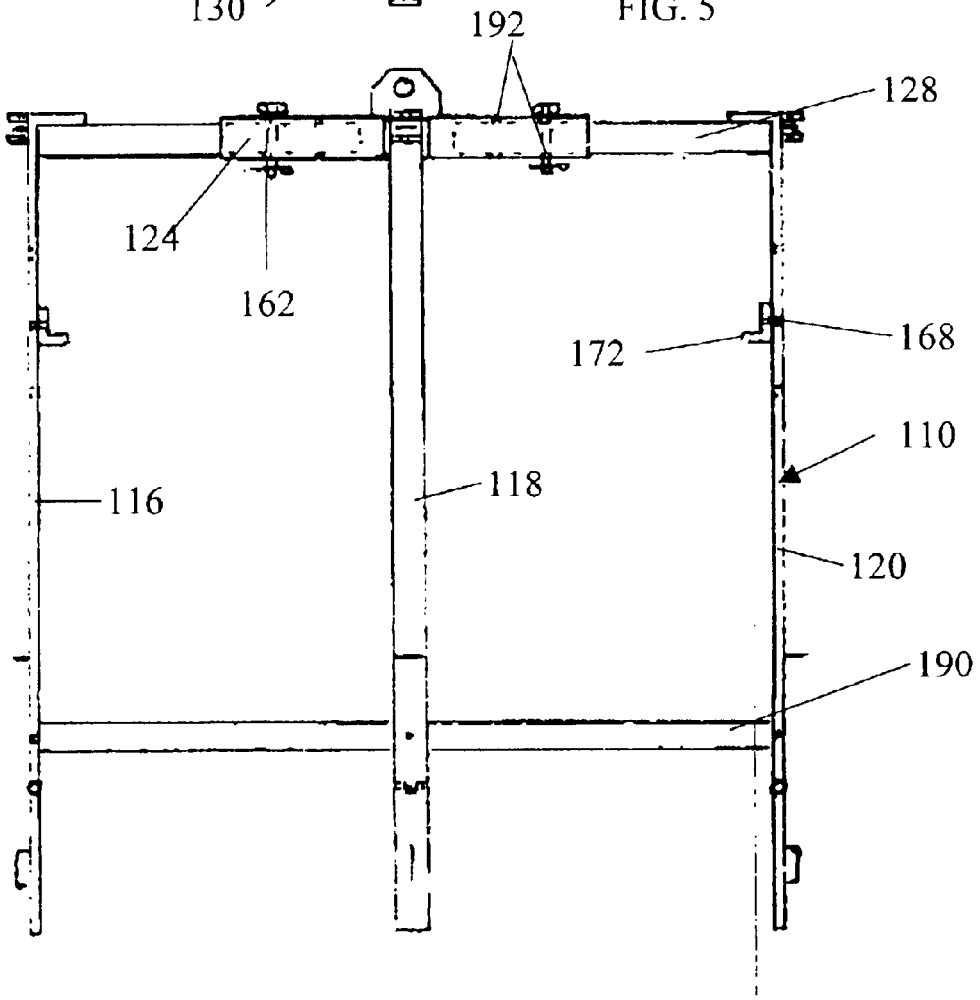
FIG. 5A is a side view of another embodiment of the invention.

FIGS. 5 and 5A shows another embodiment of the invention. This embodiment is designed to fit crucibles of several different sizes. In the preferred embodiment of the design of FIGS. 5 and 5A, the fabricated metal assembly 110 is made of steel. Fabricated metal assembly can be made of other materials that are known in the art. FIG. 5 is a top view of the fabricated metal assembly 110. FIG. 5 shows a fabricated metal assembly as four legs 112, 113, 114, and 115 that are assembled in a plus sign. By looking at FIGS. 5 and 5A, one can see that each of the four legs 112, 113, 114 and 115, is attached to one of the four vertical side pieces 116, 118, 120 and 122. The four vertical side pieces 116, 118, 120 and 122 are attached to the ends of the four legs 112, 113, 114 and 115 by welding. However, other methods of attachment known in the art can be used.

The four legs 112, 113, 114, and 115 are assembled as follows: Three pieces of box channel 124 and 126, are attached together in the center forming a shape similar to a plus sign. Into each of the four ends of the two pieces of box channel 124 and 126, are run a piece of smaller box channel 128, 130, 132 and 134. This smaller box channel 128, 130, 132, and 134 is adapted such that the smaller box channel 128, 130, 132, and 134 will easily move in and out of the two pieces of box channel 124 and 126. To the ends of the smaller box channel 128, 130, 132 and 134 that are not within box channel 124 and 126 are attached the four vertical pieces 116, 118, 120 and 122. In the center of the top piece of the box channel 124, a lifting lug 28 is placed. This lifting lug 28 is placed directly in the center of box channel 124 to provide balance for vertical lifting of the assembly 110. To the end of the smaller box channels 128 and 130, which fit within box channel 124 an upper lifting strap retainer 32 is welded into position. The upper lift strap retainer 32 could be attached by other methods known in the art.

A removable ring 190 is attached to each of the four vertical pieces 116, 118, 120, and 122 near the end of the four vertical pieces 116, 118, 120, and 122. In the preferred embodiment, the ring is attached with bolts so that it can easily be removed. The rings diameter is just slightly larger than the crucible 30. A different size ring 190 is necessary for each crucible 30 of a different diameter.

Four hinged lifting struts 34, 36, 38, and 40 are attached to the vertical pieces 116, 118, 120, and 122. These hinged lifting struts 34, 36, 38, and 40 are attached to the end of the four vertical pieces 116, 118, 120 and 122 that are attached to the smaller box channels 128, 130, 132 and 134. These hinged lifting struts 34, 36, 38, and 40 are made of steel bar stock. Each of the four hinged lifting struts 34, 36, 38, and 40 has a female hinge bracket welded in place at one end. The four vertical pieces 116, 118, 120 and 122 have attached at their end that is not attached to the smaller box channel 128, 130, 132 and 134 a male hinge bracket. The female hinge bracket attached to hinged lifting struts 34, 36, 38, and 40 is adapted to attach to the male hinge bracket at the end of each of the vertical pieces 116, 118, 120 and 122. Attached to each of the four lifting struts 34, 36, 38, and 40 is a lower rigging retainer 44. Through each of these lower rigging retainers 44 the rigging is threaded.

As in the previous embodiment, the rigging can be cable or industrial strapping. The rigging is thread as in the previous embodiment. First, the cable 46 is run through the lower rigging retainer 44 of hinged lifting struts 38 and 40 and cable 47 is run through the lower rigging retainer 44 of hinged lifting struts 34 and 36. Second, loop 48 on cable 46 is run through loop 53 on cable 47. Loop 48 of cable 46 is then run through the upper rigging retainer 32. Loop 55 on cable 47 is run through loop 49 on cable 46. Loop 55 of cable 47 is then run through the upper rigging retainer 32. Thus when the cables 46 and 47 are attached to the lifting device 53 through loops 48 and 55 and the lifting device moves upward the cables 46 and 47 place pressure on the hinged lifting struts 34, 36, 38, and 40 and they move inward griping the crucible 30 as shown in FIG. 6.

For the industrial strapping is used, first the strap 45 is run through the lower rigging retainer 44 of hinged lifting struts 38 and 40 and strap 51 is run through the lower rigging retainer 44 of hinged lifting struts 34 and 36. Second, buckle 50 on strap 45 is run through loop 57 on strap 51. Buckle 50 of strap 45 is then run through the upper rigging retainer 32. Buckle 50 on strap 51 is run through loop 55 on strap 45. Buckle 50 of strap 51 is then run through the upper rigging retainer 32. Thus when the straps 45 and 51 are attached to the lifting device 53 through buckle 50 and the lifting device moves upward the straps 45 and 51 place pressure on the hinged lifting struts 34, 36, 38, and 40 and they move inward griping the crucible 30.

To use the fabricated metal assembly 110, one must first adjust the legs 112, 113, 114, and 115. To adjust the legs 112, 113, 114 and 115, one pulls the smaller box channels 128, 130, 132, and 134 from the box channels 124 and 126. Box channel 124 and 126 has an opening 192. In each of the smaller box channels 128, 130, 132 and 134 are a set of openings. These openings 192 and the set of openings are adapted that the openings 192 in box channel 124 and 126 line up with the set of openings in smaller box channel 128, 130, 132, and 134. The legs 112, 113, 114 and 115 are lengthened or shortened by pulling out or pushing in on the smaller box channels 128, 130, 132 and 134 to a position that the legs 112, 113, 114 and 115 are just slightly longer than the diameter of the crucible 30. When one finds the legs 112, 113, 114 and 115 are slightly longer then the diameter, one lines up the nearest opening 197 in the smaller box channels 128, 130, 132 and 134 with one of the openings 193 in the box channel 124 and 126 and places a pin 162 to hold the smaller box channels 128, 130, 132 and 134 in place. Then the proper sized ring 190 is attached to the four vertical pieces 116, 118, 120, and 122.

The fabricated metal frame 110 can also be adjusted to fit crucible 30 of different height. Each of the four vertical pieces 116, 118, 120 and 122 has several sets of openings 168. These openings 168 are adapted to hold a bolt 170. An L shaped adjustable height bracket 172 also has an opening 174 through which bolt 170 fits. To adjust the height properly, one measures the distance from the top of the crucible 30 to the point where the crucible's 30 outside diameter begins to lessen. Then one measures vertical pieces 116, 118, 120 and 122 from their bottom end where the male hinge bracket is attached and moves up the side of the vertical pieces 116, 118, 120 and 122 to an opening in the set of openings 168 that is just below the measurement from the crucible 30. One places the adjustable height bracket 172 at this point by placing the bolt 170 through the opening 174 in the adjustable height bracket 172 and the opening in the set of openings 168 in the vertical pieces 116, 118, 120, and 122. One does this for all four vertical pieces 116, 118, 120, and 122.

After the height and the diameter of the fabricated metal assembly 110 are adjusted, one moves the fabricated metal assembly 110 into position over the crucible 30. This can be done by using the lifting lugs 28 on the box channel 124 of the fabricated metal assembly 110. The lifting lug 28 is attached to a vertical lifting device 52 such as a forklift. This is usually done by a set of chains and hook 54 being attached to the lifting lug 28 and moving the vertical lifting device 52 upward. The vertical lifting device 52 then positions the fabricated metal assembly 110 over the furnace. Then the vertical lifting device 52 begins to lower the fabricated metal assembly 110. The fabricated metal assembly 110 is positioned by individuals around the crucible 30. The chain 54 is then detached from the lifting lug 28 and attached to the rigging. As the upward pressure is applied by the vertical lifting device 52 to the rigging, the rigging securely grasps the bottom of the crucible 30. The continued upward movement of the vertical lifting device 52 removes the crucible 30 from the furnace. Once clear of the furnace, the vertical lifting device 52 and the crucible 30 are moved to another location.

To place a new crucible 30 back in the furnace the fabricated metal assembly 110 is lowered over crucible 30 by the lifting device 52. The chain 54 is then detached from the lifting lug 28 and attached to the rigging. The crucible 30 is then moved by the vertical lifting device 52 into place over the furnace and the vertical lifting device 52 lowers the crucible 30 into the furnace. Once the crucible 30 is in place the vertical lifting device 52 continues to lower to take the pressure off the rigging. The rigging is then detached from the vertical lifting device 52. The vertical lifting device 52 then is reattached to the lifting lug 28 and lifts the fabricated metal assembly 110 out of the furnace and off the crucible 30. The crucible 30 is now in place and ready for use.

Changes and modifications in the specifically described embodiments can be carried out without departing from the scope of the invention which is intended to be limited only by the scope of the appending claims.

I claim:

1. A handling device for lifting a crucible with a diameter that releasably attaches the crucible to lifting device for lifting and lowering comprising:

a. a frame that has leg pieces each with a center end and an outward end and whose length is slightly larger than the radius of the crucible and the leg pieces are attached together at a point at the center end and, the frame has vertical pieces, each with a top and bottom end and each of the vertical pieces' top end attaches to the outward end of the leg piece such that when the frame is centered over the crucible the frame is slightly larger than the crucible's diameter and hinged pieces attached to the bottom end of each of the vertical pieces and each hinged piece has a bottom ringing retainer and the frames heights is approximately the crucible's height; and, b. rigging adapted to pass through the bottom rigging retainer; and c. a top rigging retainer means that is adapted to allow the rigging to pass through it attached to the top of the frame; and, d. a means for attaching rigging to the lifting device; and, e. a means for attaching the frame to the lifting device; and f. whereas the lifting device is attached to the frame and the frame is then positioned over the crucible and said frame is lowered by the lifting device and positioned over the crucible and lowered and said means for attaching the frame to the lifting device is detached and said rigging is attached to the lifting device, and the lifting device begins to lift enabling the frame and the rigging to securely grab the crucible and as said lifting device continues the crucible is lifted.

2. A handling device for lifting a crucible that releasably attaches the crucible to lifting device for lifting and lowering as in claim 1 whereas:

a. the frame is adjustable so it can fit many sizes of crucibles.

3. A handling device for lifting a crucible that releasably attaches the crucible to lifting device for lifting and lowering as in claim 2 further comprising:

a. lower ring of a diameter slightly larger than the crucible's diameter attached to the frame.

4. A handling device for lifting a crucible that releasably attaches the crucible to lifting device for lifting and lowering as in claim 1 whereas:

a. the rigging comprises
(1). a first cable with ends; and,
(2). a second cable with ends.

5. A handling device for lifting a crucible that releasably attaches the crucible to lifting device for lifting and lowering as in claim 1 whereas:

a. the rigging comprises:
(1). a first belt with ends; and,
(2). a second belt with ends.

6. A handling device for lifting a crucible that releasably attaches the crucible to lifting device for lifting and lowering as in claim 5 whereas: a. the means for attaching the rigging to the lifting device is a buckle on one of end of each the first and second belt and a set of chains that attaches to the lifting device and the buckle.

7. A handling device for lifting a crucible that releasably attaches the crucible to lifting device for lifting and lowering as in claim 4 whereas: a. the means for attaching the rigging to the lifting device is a loop one end of each of the first and second cable and a set of chains that attaches to the lifting device and the loop.

8. A handling device for lifting a crucible that releasably attaches the crucible to lifting device for lifting and lowering comprising:

a. the frame comprises:
(1). a leg piece with ends; and
(2). a upper ring with a diameter that is slightly larger than the diameter of the crucible and each end of the leg piece is attached to the upper ring and the leg piece passes through the center of the circle formed by the ring; and
(3). vertical pieces, each with a top and bottom end and each of the vertical pieces is attached to the upper ring near the top end of the vertical piece and two of the vertical pieces attach to the leg piece at the leg piece's ends, and,
(4). hinged pieces attached to the bottom end of each of the vertical pieces and each hinged piece has a lower rigging retainer; and b. rigging; and, c. a top rigging retainer means that is adapted to allow the rigging to pass through it attached to the top of the frame; and, d. a means for attaching rigging to the lifting device; and, e. a means for attaching the frame to the lifting device; and f. whereas the lifting device is attached to the frame and the frame is then positioned over the crucible and said frame is lowered by the lifting device and positioned over the crucible and lowered and said means for attaching the frame to the lifting device is detached and said rigging is attached to the lifting device, and the lifting device begins to lift enabling the frame and the rigging to securely grab the crucible and as said lifting device continues the crucible is lifted.

9. A handling device for lifting a crucible that releasably attaches the crucible to lifting device for lifting and lowering as in claim 2 whereas:

a. the leg pieces are adjustable in length.

10. A handling device for lifting a crucible that releasably attaches the crucible to lifting device for lifting and lowering as in claim 4 whereas:

a. the first and second cables have loops on each end.

11. A handling device for lifting a crucible that releasably attaches the crucible to lifting device for lifting and lowering as in claim 5 whereas:

a. the first and second belts have a loop on one end and a buckle on the other.

12. A handling device for lifting a crucible that releasably attaches the crucible to lifting device for lifting and lowering as in claim 10 whereas:

a. there are four vertical pieces and a first, second, third and fourth hinged pieces.

13. A handling device for lifting a crucible that releasably attaches the crucible to lifting device for lifting and lowering as in claim 11 whereas:

a. there are four vertical pieces and a first, second, third and fourth hinged pieces.

14. A handling device for lifting a crucible that releasably attaches the crucible to lifting device for lifting and lowering as in claim 11 whereas:

a. one of the loop ends of the first cables is run through the lower rigging retainer on the first hinged piece, and then through the lower rigging retainer on the second hinged piece which is next to the first hinged piece then through a loop on an end of the second cable and then through the upper rigging retainer, and b. the loop on the end of the second cable not around the first cable is first past through the rigging retainer on the third hinged piece and through the rigging retainer on the forth hinged piece then through the loop on the end the first cable which was not run through the hinged pieces, and then through the upper rigging retainer.

15. A handling device for lifting a crucible that releasably attaches the crucible to lifting device for lifting and lowering as in claim 12 whereas:

a. the buckle ends of the first belt is run through the loop on the end of the second belt and then through the lower rigging retainer on the first hinged piece, and then through the lower rigging retainer on the second hinged piece which is next to the first hinged piece, and then through the upper rigging retainer; and, b. the buckle the second cable is first past through the rigging retainer on the third hinged piece and through the rigging retainer on the forth hinged piece then through the loop on the end the first cable, and then through the upper rigging retainer.

* * * * *